United States Patent [19]

Von Muller

[11] 4,384,420

[45] May 24, 1983

[54] FIREARM MAGAZINE LOCK

[76] Inventor: Francis Von Muller, 153 State St., Brooklyn, N.Y. 11201

[21] Appl. No.: 183,426

[22] Filed: Sep. 2, 1980

[51] Int. Cl.[3] ..... F41C 17/08

[52] U.S. Cl. ..... 42/1 LP

[58] Field of Search ..... 42/1 LP

[56] References Cited

U.S. PATENT DOCUMENTS

| | | | |
|---|---|---|---|
| 2,945,316 | 7/1960 | Mulno | 42/1 LP |
| 3,018,576 | 1/1962 | Riechers | 42/1 LP |
| 3,089,272 | 5/1963 | McKinlay | 42/1 LP |
| 3,553,877 | 1/1971 | Welch et al. | 42/1 LP |
| 3,673,725 | 7/1972 | Cravener | 42/1 LP |

*Primary Examiner*—Charles T. Jordan
*Attorney, Agent, or Firm*—Paul J. Sutton

[57] ABSTRACT

In firearms which have a removable magazine feed, provision is made to insert a key operated safety magazine unit which replaces the existing magazine unit. The safety magazine unit locks itself into the magazine well of the firearm when actuated by a removable key. Locking of the safety magazine unit prevents its removal from the magazine well of the firearm and replacement by a magazine with live ammunition. Locking of the safety magazine unit also immobilizes the firing mechanism of the firearm. Immobilization results from an internal blocking of the breech or bolt action necessary for the weapon to be opened or fired. Installation of a safety magazine unit completely immobilizes the firearm preventing its unauthorized firing. The safety magazine unit does not interfere with any of the weapon's inherent safety features.

7 Claims, 6 Drawing Figures

FIG. 1
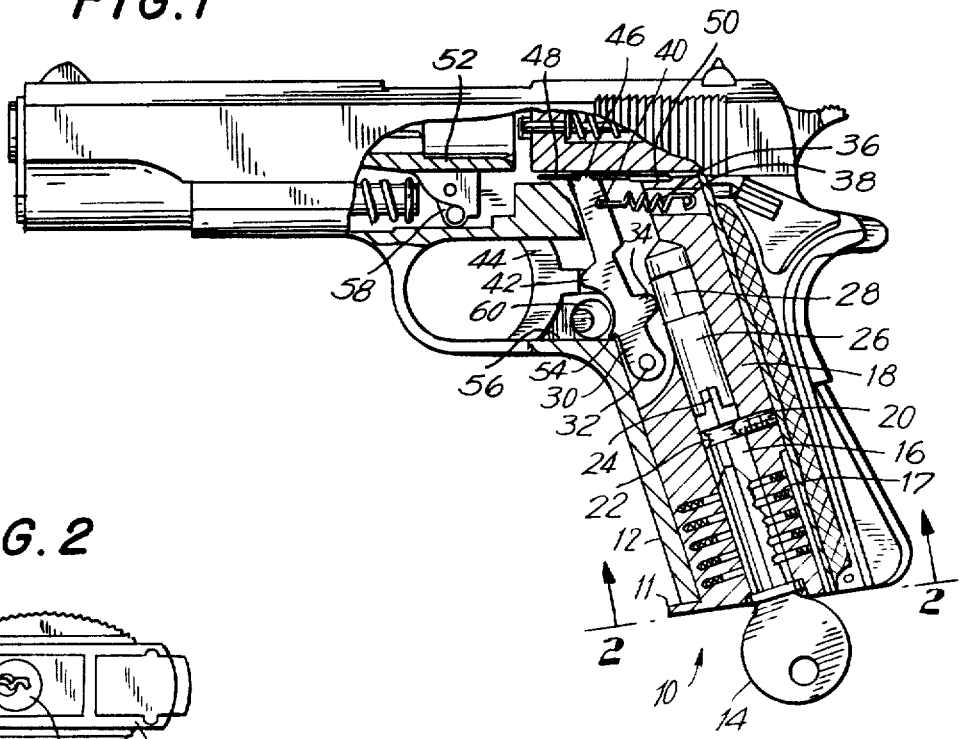
FIG. 2
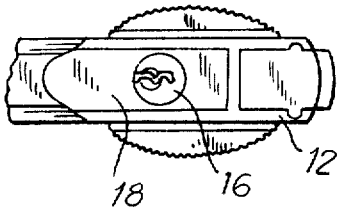
FIG. 3
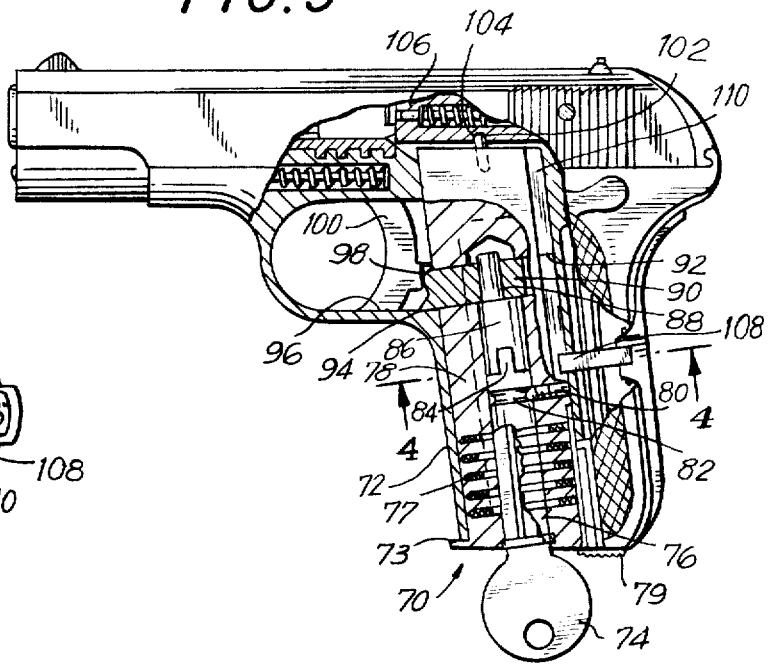
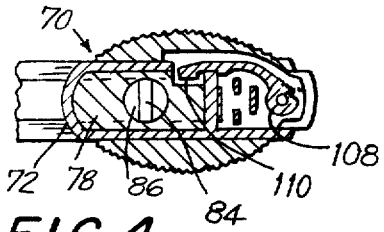
FIG. 4

FIREARM MAGAZINE LOCK

BACKGROUND OF INVENTION

The present invention relates to firearms. In particular the present invention relates to firearms which are provided with magazines which are removeably connected to the firearm and are releasably held in position by suitable retaining mechanism.

The safety and security of firearms has been a concern of military and civilian personnel for as long as firearms have been used. When firearms are stored or shipped it is desirable to prevent unauthorized use. When firearms are handled during instruction, placed on exhibition or used during parades it is necessary to ensure their safety.

DESCRIPTION OF PRIOR ART

Let us now look at certain prior art patents which, while not anticipatory of the present invention, disclose representative examples of previous or known efforts to solve some of the problems associated with the art embodying this invention.

U.S. Pat. No. 3,415,000 to Koucky discloses a catch lever 1 which is provided to prevent trigger member 12 from operating if magazine 2 is not in the firearm. This configuration does not prevent the unauthorized return of a loaded magazine to the firearm.

U.S. Pat. No. 3,715,826 to Seifried shows a ratchet 8 projecting into a groove 10A of a magazine 10. When magazine 10 is in the firearm and in the fully engaged position, the firearm can be fired. If magazine 10 is removed or not fully engaged, the firearm can not be fired. This arrangement can be easily bypassed if unauthorized use of the firearm is desired.

Thomas's U.S. Pat. No. 4,031,648 shows a trigger bar 34 which abuts trigger 32 and prevents actuation of firing pin 21 when magazine 83 is removed. This configuration again does not prevent unauthorized use of firearm.

While I do not wish to minimize the inventiveness and efforts of the inventors associated with the aforesaid and prior patents and while these people may be attempting to solve a problem similar to some of the problems solved by the present invention, it may be useful to comment on the aforementioned methods. The foregoing inventions address themselves to minimizing accidental discharge during firearm handling. In none of the foregoing devices is there any attempt to prevent unauthorized use of the firearm.

SUMMARY OF THE INVENTION

The primary object of the present invention is to provide a new and novel safety magazine unit for use with firearms having a detachable magazine feed;

Another object of this invention is to prevent firing of the last round in the chamber of a magazine fed firearm;

Still another object of this invention is to provide a safety magazine unit which to all outward appearances appears to carry live ammunition and is interchangeable with a standard magazine;

Yet another object of this invention is to provide a safety magazine which does not interfere with the conventional holstering or storage of the firearm;

A further object of this invention is to provide a simpler method for temporarily disabling target type pistols;

Still a further object of this invention is to provide a safety magazine which can be fitted to a fiream with no dissambly of the firearm.

BRIEF DESCRIPTION OF DRAWINGS

The foregoing and other objects, features and advantages of the present invention will become apparent from the detailed description herein after considered in conjunction with the accompanying drawings, wherein:

FIG. 1 is a plan fragmentary sectional view of a colt type automatic pistol;

FIG. 2 is a view of FIG. 1 in the direction of arrows 2—2;

FIG. 3 is a plan fragmentary sectional view of a typical blowback operated automatic pistol;

FIG. 4 is a sectional view of FIG. 3 in the direction of arrows 4—4;

DETAILED DESCRIPTION OF PREFERRED EMBODIMENTS

Figure 5:
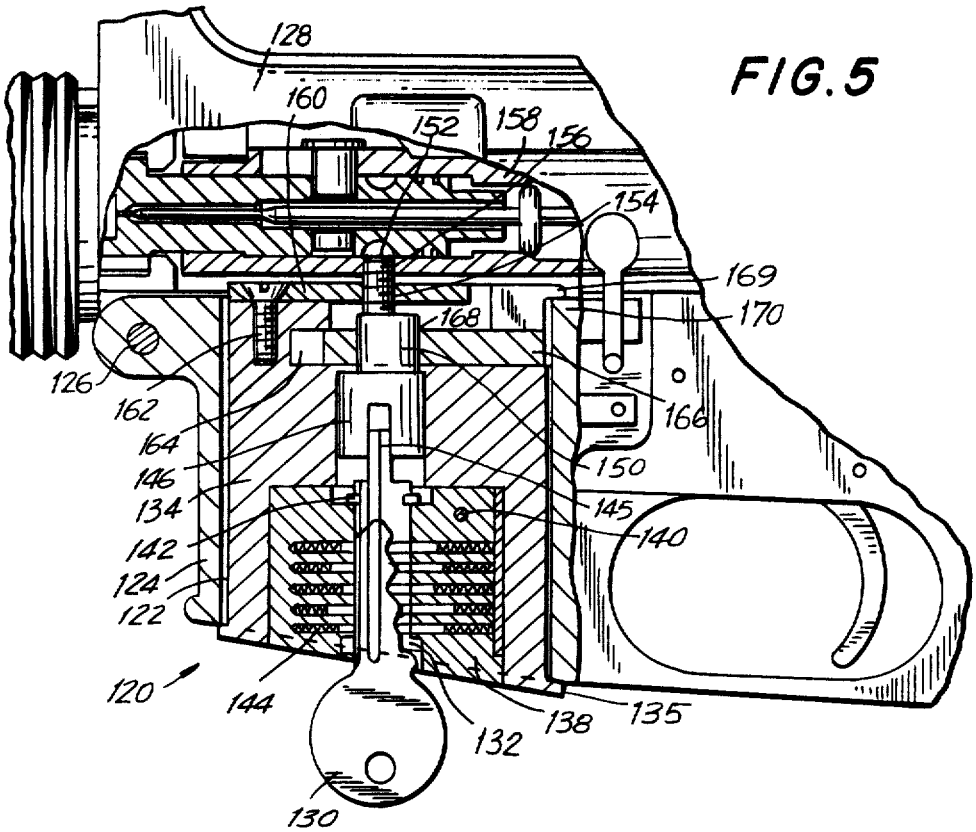
FIG. 5 is a plan fragmentary sectional plan view of an automatic rifle of the M16 design.

Referring now to FIG. 1, there is shown a fragmentary sectional view of a colt type automatic pistol. Those items which are standard to the colt design will not be described unless their description is necessary to the operation of this invention. This procedure will be followed with the other weapons described. The firearm shown in FIG. 1 is a first embodiment of the invention. A safety magazine, generally designated 10, is inserted into a receiver 12 which is part of the aforementioned firearm, a lip extention 11 limits entry of magazine 10. A key 14 (in the locked position) is shown inserted in a lock cylinder 16.

Lock cylinder 16 is retained in a safety magazine body 18 by a set screw 20 which engages a groove 22 in lock cylinder 16. Lock cylinder 16 also coacts with a pin assembly 17 to provide locking action. Lock cylinder 16 has a tongue 24 which engages a shaft 26 having means for receiving tongue 24. Shaft 26 and lock cylinder 16 are rotatably mounted and coaxial with each other. At the end opposite means for receiving tongue 24, shaft 26 has a cam 28 which is shown in contact with a cam lever 30. Cam lever 30 is restrained to move in a radial manner about a pivot pin 32 as can be seen in FIG. 1.

Cam lever 30 also has a cam contact surface 34 which is caused to be in contact with cam 28 by a spring 36. Spring 36 is attached to a portion of magazine safety body 18 by a pin 38 and is also attached to cam lever 30 at a hole 40. Cam lever 30 has a contact nose 42 which abuts the rear portion of a trigger 44. Trigger 44 is an existing part of the colt firearm. Proximate to contact nose 42 and midway between nose 42 and pin 32 is a wedge 54 which engages a trigger slideway 56, an existing feature of the aforementioned firearm. Cam lever 30 has at the end remote from pivot pin 32 a projection 46 which coactingly engages a slideable part 48. Slideable part 48 is slideably affixed to safety magazine body 18 by means not shown. A recess 50 permits slideable part 48 to fully retract thereby enabling removal of safety magazine unit 10 when unlocked. Also shown as an existing part of the aforementioned firearm is a link 58 a barrel 52 and a magazine release 60 which will be referred to later.

FIG. 2 is a view of FIG. 1 in the direction of arrows 2—2 and shows safety magazine unit 18 locked in place and giving the appearance of a conventional magazine clip inserted into receiver 12 of the firearm. Lock cylinder 16 is the only evidence that safety magazine unit 10 is unconventional.

Examination of FIG. 3 shows a fragmentary sectional view of a typical blowback operated automatic pistol of the pocket type. Here is shown a second embodiment of a safety magazine unit, generally designated, 70 inserted into a receiver 72 which is part of the blowback operated pistol. Entry of magazine 70 into receiver 72 is limited by a lip extension 73.

A key 74 (in the locked position) is shown inserted in a lock cylinder 76. Lock cylinder 76 coacts with a pin assembly 77 to provide locking action. Lock cylinder 76 is retained in a safety magazine body 78 by a set screw 80 which engages a groove 82 in lock cylinder 76. Lock cylinder 76 can be seen to have a tongue 84 which engages a shaft 86 having means for receiving tongue 84. Shaft 86 and lock cylinder 76 are rotatably mounted and coaxial with each other. At the end opposite means for receiving tongue 84, shaft 86 has an eccentric pin 88 affixed to it. Eccentric pin 88 is received by a slide 90 which slideably moves in a guideway 92 machined into safety magazine body 78. Slide 90 has at one end thereof a wedge 94 which engages a trigger slideway 96 which is an existing part of receiver 72 of the firearm shown in FIG. 3. Proximate to wedge 94 is a contact nose 98 which abuts a trigger 100 which is part of the presently described pistol. Affixed to safety magazine body 78, at the end opposite to key 74, is a pin 102 which fits into a drilled hole 104. Hole 104 is drilled in the underside of a pistol slide 106 which is part of the aforementioned blow back pistol. Toward the rear of the pistol's handle and midway between the top and bottom of the handle is a safety lever 108. Safety lever 108 is a safety provided by the pistol designers to prevent trigger 100 actuation when the magazine is removed. Magazine safety body 78 contains a channel 110, best seen in FIG. 4, which permits safety lever 108 to be operative when the pistol is used with safety magazine unit 70. Further, a standard magazine catch 79, part of the aforementioned pistol, is fully operative when safety magazine unit 70 is inserted.

Attention to FIG. 4 shows that it is a sectional view of FIG. 3 taken in the direction of arrows 4—4. FIG. 4 best shows channel 110 which is provided in safety magazine body 78 to clear safety lever 108. Also seen is tongue 84 and shaft 86.

FIG. 5 shows yet a third embodiment of the invention applied to an automatic rifle of the M16 type. A safety magazine unit, generally designated, 120 shows how the third embodiment is practiced. Safety magazine unit 120 is shown inserted into a magazine well 122 which is part of a lower receiver 124 both being part of the aforementioned rifle. Lower receiver 124 is attached to an upper receiver 128 by means of a hinge pin 126 and a dismount pin (not shown) located at the rear of upper receiver 128, all the foregoing items are also part of the M16 rifle.

A key 130 (seen in the locked position) is shown inserted in a lock cylinder 132. Lock cylinder 132 is retained in a lock cylinder carrier 138 by a lock collar 142. Lock cylinder carrier 138 is affixed to a safety magazine body 134 by a pin 140.

A pin tumbler assembly 144 is provided to make possible a large number of key combinations. Lock cylinder 132 is seen to have a tongue 145 which slideably engages a shaft 146 having means for slideably receiving tongue 145. Shaft 146 and lock cylinder 132 are rotatably mounted and coaxial with each other. At the end opposite means for receiving tongue 145, shaft 146 has affixed an eccentric boss 150. Affixed to the upper end of boss 150 is a multiple lead screw 152 concentric with shaft 146. Multiple lead screw 152 is shown passing through a multiple threaded guide hole 154 and thence into a multiple threaded locking hole 156. Multiple thread locking hole 156 is drilled and tapped in a rifle bolt carrier 158, said carrier being part of the aforementioned rile. A guide plate 160 contains guide hole 154 and serves as an alignment device for multiple lead screw 152. Guide plate 160 is affixed to magazine safety body 134 by means of a screw 162 which maintains alignment of guide hole 154 with locking hole 156.

Magazine safety body 134 contains a slideway 164 which slideably supports a latch 166 having an opening 168 for coacting with eccentric boss 150. Latch 166 has a catch 169 which protrudes over a rear wall 170 of magazine well 122. Magazine body 134 is seen to have a magazine lip extension 135 which abuts the bottom of magazine well 122 and limits the entry of magazine safety body 134 into lower receiver 124.

Figure 6:
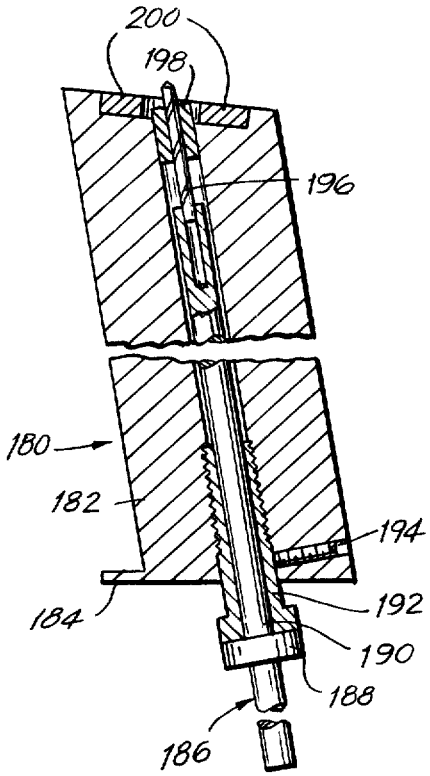
FIG. 6 is a plan sectional view of a typical drilling unit.

FIG. 6 illustrates a typical drilling unit generally designated 180, which is used to spot and drill the hole which mates with the pin or screw of the particular safety magazine unit selected for use with the firearm being fitted.

Drilling unit 180 consists of a drilling unit body 182 having a lip extention 184 for limiting the entry of drilling unit 180 into the firearm receiver. Drilling unit 180 readily interchanges with the regular firearm magazine. Assembled into drilling unit body 182 is a drilling assembly 186 consisting of a limiting collar 188 affixed to a shaft 190 which is closely fitted to a drill guide bushing 192 threaded into body 182. Guide bushing 192 is affixed to body 182 by a set screw 194. Brazed onto shaft 190 and coaxial with it is a drill 196 which is contained in drill guide bushing 198, also coaxial with shaft 90. Imbedded in the top surface of body 182 is a set of bar magnets 200 which attract drill chips to itself.

OPERATION OF PREFERRED EMBODIMENTS

The operation of making safe the colt type automatic pistol, shown in FIG. 1 by installation of safety magazine unit 10 requires the user to first unload the firearm. Unloading is accomplished by removing the magazine, opening the action to remove a round from the chamber if necessary, and then closing the action and placing the hammer in the down position. After magazine safety unit 10 is verified to be in the unlocked state, it is inserted into receiver 12, and the standard magazine release 60, part of the firearm will function to retain magazine safety unit 10 in place.

Key 14 is then inserted and rotated 180 degrees which causes lock cylinder 16 to rotate shaft 26. Rotation of shaft 26 causes cam 28 to contact cam surface 34 and rotate cam lever 30 into the locked position as shown in FIG. 1. When cam lever 30 assumes a locked position, contact nose 42 abuts the rear portion of trigger 44, thereby preventing its movement. Wedge 54, also part of cam lever 30 abuts the trigger slideway 56, and provides locking action which prevents removal of safety magazine unit 10. Cam lever 30 also has attached to its upper end, slideable part 48, which moves forward into the gap between the rear underside of the barrel 52 and the top of the receiver 12. With slideable part 48 in this position, barrel 52 is prevented from moving downward on its link 58, as normally occurs during unbreeching, thereby locking the action of the pistol closed and making the introduction of ammunition impossible. Key 14 can then be removed from lock cylinder 16 and stored in a safe place.

Making safe the typical blow back automatic pistol, such as shown in FIG. 3 is accomplished by first removing its magazine from the receiver 72, and then unloading the firing chamber. Upon removal of its magazine from the weapon, safety lever 108 is actuated and the pistol is secured againse discharge. Magazine safety unit 70, designed for use with this particular weapon, incorporates channel 110, best seen in FIG. 4, which clears safety lever 108 enabling it to remain operative. After magazine safety unit 70 is verified to be in the unlocked state, it is inserted in receiver 72 until lip extention 73 abuts the bottom of the receiver 72. In this position the standard magazine catch 79 of the pistol will function to retain the magazine safety unit 70 in place.

Key 74 is then inserted and rotated 180 degrees which causes lock cylinder 76 and shaft 86 with eccentric pin 88 to rotate a likewise amount, causing slide 90 to extend from magazine body 78. This motion of slide 90 causes contact nose 98 to abut the rear portion of trigger 100 and wedge 94 to abut the lower surface of the trigger slideway 96, as shown in FIG. 3. Contact nose 98 thus prevents trigger 100 from being pulled and wedge 94 blocks removal of magazine safety unit 70 from the weapon. Pin 102 is now also inserted in drilled hole 104 and thereby prevents slide 106 from being opened and the weapon loaded with ammunition. Key 74 can then be removed from lock cylinder 76 and stored in a safe place.

The rifle shown in FIG. 5 is prepared in the following manner. The magazine is removed, chamber unloaded, and bolt carrier closed. Magazine safety unit 120 is first verified to be in the unlocked position and then inserted in magazine well 122 of the firearm until extension lip 135 abuts the lower receiver 124, at which position the standard magazine catch of the weapon will function to retain the magazine safety unit 120 in place in the rifle. Key 130 is then inserted in lock cylinder 132 and turned 180 degrees, which causes shaft 146 with eccentric boss 150 to also rotate and force slide 166 to move rearward in the gun, latching catch 169 over top of rear magazine well 170. The preceding action causes the magazine safety unit 120 to be securely locked to the lower receiver 124, preventing its removal and replacement with a loaded magazine. As key 130 is rotated it also causes multiple lead screw 152 to advance upward, guided by guide hole 154, and enter locking hole 156 in rifle bolt carrier 158. Multiple lead screw 152 offers maximum engagement with locking hole 156 on rotation of key 130, although this invention is not limited to this arrangement. The entry of multiple lead screw 152 in the rifle bolt carrier 152 simultaneously locks the weapon's breech closed and clamps the upper receiver 128 and lower receiver 124 together, thus eliminating all possibility of the insertion of live ammunition. Key 130 may now be removed and stored in a safe place.

While it is intended that my invention be applied to the manufacture of firearms so that each magazine loaded firearm be made available with a magazine safety unit as an accessory, my invention is also applicable to firearms which have been manufactured and are presently in use.

The following description applies to the retrofitting of existing firearms with my invention.

In the case of most existing blowback type automatic pistols it is necessary to predrill a hole 104 in the underside of the pistol slide 106 to accommodate pin 102 of the magazine safety unit 70 as shown in FIG. 3. To facilitate the drilling of this hole without disassembly of the pistol or use of complicated machinery, there has been provided a drilling unit 180 as shown in FIG. 6. The drilling unit 180 has been designed to properly fit the magazine well of each type of firearm to be retrofitted, replacing its regular magazine. By inserting drilling unit 180 and powering drilling assembly 186 by means of an electric drill or equivalent, the required hole may be easily drilled in the slide of a pistol, or in the bolt carrier of a rifle. The exact depth of the required hole is attained in the drilling operation when limiting collar 188 impinges on the bottom surface of guide bushing 192 as shown in FIG. 6. Bar magnets 200 serve to attract and hold drill chips generated during the drilling operation to prevent entrance of the drill chips into the mechanism of the firearm.

The locking hole required for magazine loading rifles such as that shown in FIG. 5, may be produced by a suitably dimensioned drilling unit functionally equivalent to that used with the blowback pistol. Two such units would be required, one for drilling and one for threading. The conversion of a large number of weapons would best be handled by the application of production machinery methods directly to the parts involved.

The embodiments of the invention particularly disclosed and described herein above are presented merely as examples of the invention; other embodiments, forms, and modifications of the invention coming within the proper scope and spirit of the appended claims will of course readily suggest themselves to those skilled in the arts.

I claim:

1. In a firearm having a receiver for removably receiving a magazine containing cartridges, loading means for loading said cartridges in a firing chamber and trigger means for firing said cartridges, wherein the improvement comprises:

a safety magazine operable with said receiver, said safety magazine having a lip extension for limiting said safety magazine entrance into said receiver;

a key operated lock cylinder having a pin tumbler operably secured in said safety magazine, said lock cylinder being connected to a shaft having a cam portion affixed at an end remote from said lock cylinder, said lock cylinder being coaxial with said shaft and accessible from said lip extension portion of said safety magazine;

a wedge member, operably connected to said cam portion being made to engage a portion of said firearm by rotation of a key inserted into said key operated lock cylinder whereby said safety magazine is locked into said receiver, removal of said key preventing unauthorized removal of said safety magazine and making said firearm safe.

2. The firearm of claim 1 wherein, said shaft is provided with a screw affixed to said shaft remote from said lock cylinder, rotation of said shaft causing said screw to enter a threaded hole provided in said loading means whereby said screw prevents said loading means from being operable thereby disabling said firearm.

3. The firearm of claim 1 wherein, said wedge member has affixed a contact nose which causes said trigger means to be inoperative when said safety magazine is locked into said receiver.

4. The firearm of claim 3 wherein, said safety magazine has a pin affixed to a portion of said safety magazine remote from said lip extension, said pin engaging a hole provided in said loading means whereby said pin prevents said loading means from being operable thereby disabling said firearm.

5. The firearm of claim 3 wherein, said wedge member further comprises a cam lever having a slideable part which prevents operation of said loading means when said safety magazine is locked into said receiver.

6. A method of making safe a firearm having receiving means for removably receiving a magazine containing cartridges, loading means for loading said cartridges in a firing chamber and trigger means for firing said cartridges which comprises:

preparing said firearm by removing said magazine and clearing said firing chamber;

inserting a safety magazine into said receiving means, said safety magazine having a key operated tumbler;

operating a wedge member within said safety magazine by rotation of said key operated pin tumbler so as to lock said safety magazine into said receiving means and removing said key, whereby said firearm is made safe.

7. A method of making safe a firearm having receiving means for removably receiving a magazine containing cartridges, loading means for loading said cartridges in a firing chamber and trigger means for firing said cartridges which comprises (a) preparing said firearm for being made safe;

(b) inserting a member into said receiving means, said member having means for coacting with said trigger means in order to prevent operation of said firearm when said member is in said receiving means; and (c) operating means for coacting with said loading means in order to prevent operation of said firearm.

* * * * *